US005876513A

United States Patent [19]

Frankson

[11] Patent Number: 5,876,513

[45] Date of Patent: Mar. 2, 1999

[54] METHOD AND KIT FOR CLEANING JEWELRY AND OTHER SMALL PARTS

[76] Inventor: Jon Frankson, 216 James Ave., McComb, Miss. 39648

[21] Appl. No.: 980,604

[22] Filed: Dec. 1, 1997

[51] Int. Cl.[6] ..... B08B 3/04; B08B 3/06; B08B 3/08

[52] U.S. Cl. ..... 134/25.1; 134/25.4; 134/29; 134/30; 134/34; 134/42; 134/134

[58] Field of Search ..... 134/25.4, 42, 135, 134/25.1, 34, 29, 30

[56] References Cited

U.S. PATENT DOCUMENTS

| | | | |
|---|---|---|---|
| 3,894,551 | 7/1975 | Stohlman | 134/135 |
| 5,000,209 | 3/1991 | Mann | 134/135 |
| 5,209,784 | 5/1993 | Bellman | 134/25.4 |

*Primary Examiner*—Zeinab El-Arini
*Attorney, Agent, or Firm*—Wagner, Middlebrook & Kimbell, LLP

[57] ABSTRACT

A method and kit for cleaning jewelry and small parts to 95% and greater clean. A holding basket has a plurality of apertures formed therein, and is adapted to securely retain jewelry and small parts therein. Jewelry is placed in the holding basket and dunked into a container filled with cleaning solution to coat the jewelry with cleaning solution. The holding basket is removed from the container of cleaning solution, and is placed in an automatic dishwasher and run through a wash cycle and dry cycle, thereby exposing the jewelry to impinging water and the action of steam to remove the cleaning solution and grime from the jewelry and small parts. The steam helps prevents formation of water spots. The kit includes a hinged jewelry holding basket with handles and a container filled with cleaning solution. The hinged jewelry holding basket is sized to be dunked into the cleaning solution.

8 Claims, 6 Drawing Sheets

FIGURE 5

VISCOSITY

| CONCENTRATION OF CLEANING SOLUTION | SPECIFIC GRAVITY | FUNNEL VISCOSITY |
|---|---|---|
| 100% water | 1.00 | 26 MARSH SECONDS |
| 10% cleaning solution, 90% water | 1.03 | 29 MARSH SECONDS |
| 25% cleaning solution, 75% water | 1.07 | 35 MARSH SECONDS |
| 50% cleaning solution, 50% water | 1.19 | 44 MARSH SECONDS |
| 75% cleaning solution, 25% water | 1.22 | 48 MARSH SECONDS |
| 90% cleaning solution, 10% water | 1.28 | 683 MARSH SECONDS |
| 100% cleaning solution | 1.31 | 1621 MARSH SECONDS |

FIGURE 6- JEWELRY CLEANING RESULTS (Sorted by Results)

| TEST NBR | VISCOSITY | DISHWASH CYCLE | SOAK TIME | DELAY TIME | RESULT |
|---|---|---|---|---|---|
| 79 | 50% | Pre-Heat | 15min | None | 100% |
| 11 | 75% | Pre-Heat | 30min | 0min | 100% |
| 55 | 75% | No Pre-Heat | 30min | 0min | 100% |
| 39 | 75% | No Pre-Heat | 30min | 0min | 100% |
| 18 | 75% | No Pre-Heat | 30min | 0min | 100% |
| 26 | 75% | No Pre-Heat | 30min | 0min | 100% |
| 35 | 75% | No Pre-Heat | 30min | 0min | 100% |
| 15 | 75% | No Pre-Heat | 30min | 0min | 100% |
| 45 | 75% | No Pre-Heat | 30min | 0min | 100% |
| 48 | 75% | Pre-Heat | 30min | 0min | 100% |
| 20 | 75% | No Pre-Heat | 60min | 60min | 100% |
| 19 | 75% | No Pre-Heat | 60min | 0min | 100% |
| 9 | 100% | Pre-Heat | 30min | 0min | 100% |
| 4 | 100% | No Pre-Heat | 25min | 0min | 100% |
| 5 | 75% | No Pre-Heat | 30min | 0min | 100% |
| 51 | 75% | No Pre-Heat | 30min | 0min | 100% |
| 53 | 75% | No Pre-Heat | 30min | 60min | 100% |
| 27 | 75% | No Pre-Heat | 30min | 60min | 100% |
| 21 | 75% | No Pre-Heat | 30min | 0min | 100% |
| 52 | 25% | Pre-Heat | 30min | 0min | 100% |
| 44 | 25% | Pre-Heat | 30min | 0min | 100% |
| 1 | 25% | No Pre-Heat | 30min | 0min | 100% |
| 31 | 25% | Pre-Heat | 30min | 0min | 100% |
| 14 | 25% | No Pre-Heat | 30min | 0min | 100% |
| 24 | 25% | Pre-Heat | 30min | 0min | 100% |
| 28 | 25% | No Pre-Heat | 20min | 0min | 100% |
| 2 | 25% | Pre-Heat | 20min | 0min | 100% |
| 34 | 25% | No Pre-Heat | 15min | 0min | 100% |
| 12 | 25% | No Pre-Heat | 20min | 0min | 100% |
| 38 | 25% | Pre-Heat | 20min | 0min | 100% |
| 25 | 25% | No Pre-Heat | 20min | 0min | 100% |
| 13 | 25% | Pre-Heat | 30min | 0min | 100% |
| 57 | 75% | No Pre-Heat | 20min | 0min | 100% |
| 29 | 75% | Pre-Heat | 20min | 0min | 100% |
| 30 | 75% | No Pre-Heat | 20min | 0min | 100% |
| 56 | 75% | No Pre-Heat | 30min | 0min | 100% |
| 32 | 75% | No Pre-Heat | 30min | 0min | 100% |
| 58 | 75% | No Pre-Heat | 30min | 0min | 100% |
| 41 | 25% | Pre-Heat | 30min | 60min | 100% |
| 47 | 25% | Pre-Heat | 30min | 60min | 100% |
| 43 | 25% | Pre-Heat | 30min | 120min | 100% |

| TEST NBR | VISCOSITY | DISHWASH CYCLE | SOAK TIME | DELAY TIME | RESULT |
|---|---|---|---|---|---|
| 23 | 75% | Pre-Heat | 20min | 0min | 100% |
| 6 | 75% | No Pre-Heat | 20min | 0min | 100% |
| 22 | 75% | No Pre-Heat | 20min | 0min | 100% |
| 81 | 50% | No Pre-Heat | 15min | 60min | 99% |
| 73 | 50% | No Pre-Heat | 10min | 60min | 98% |
| 69 | 50% | No Pre-Heat | 10min | None | 98% |
| 75 | 50% | No Pre-Heat | 10min | None | 98% |
| 83 | 50% | No Pre-Heat | 15min | None | 98% |
| 77 | 50% | No Pre-Heat | 15min | None | 98% |
| 36 | 100% | No-Pre-heat | 30min | 0min | 98% |
| 3 | 25% | No-Pre-Heat | 30min | 0min | 98% |
| 54 | 25% | No-Pre-Heat | 30min | 0min | 98% |
| 17 | 75% | No-Pre-Heat | 10min | 0min | 98% |
| 7 | 75% | No-Pre-Heat | 0min | 0min | 98% |
| 40 | 90% | No-Pre-Heat | 30min | 0min | 98% |
| 46 | 100% | No-Pre-Heat | 30min | 0min | 98% |
| 42 | 100% | Pre-Heat | 30min | 0min | 98% |
| 16 | 100% | No-Pre-Heat | 30min | 0min | 98% |
| 49 | 25% | Pre-Heat | 0min | 0min | 98% |
| 10 | 100% | No-Pre-Heat | 30min | 0min | 98% |
| 71 | 50% | Pre-Heat | 10min | None | 96% |
| 33 | 100% | Pre-Heat | 30min | 60min | 95% |
| 50 | 100% | Pre-Heat | 30min | 60min | 95% |
| 80 | 10% | No Pre-Heat | 15min | 60min | 95% |
| 74 | 10% | No Pre-Heat | 10min | None | 95% |
| 78 | 10% | Pre-Heat | 15min | None | 95% |
| 76 | 10% | No Pre-Heat | 10min | None | 95% |
| 72 | 10% | No Pre-Heat | 10min | 60min | 95% |
| 82 | 10% | No Pre-Heat | 15min | None | 95% |
| 68 | 10% | No Pre-Heat | 10min | None | 95% |
| 70 | 10% | Pre-Heat | 10min | None | 95% |
| 65 | 50% | No Pre-Heat | 05min | 60min | 93% |
| 61 | 50% | No Pre-Heat | 05min | None | 92% |
| 64 | 10% | No Pre-Heat | 05min | 60min | 92% |
| 67 | 50% | Pre-Heat | 05min | None | 92% |
| 63 | 50% | Pre-Heat | 05min | None | 92% |
| 60 | 10% | No Pre-Heat | 05min | None | 90% |
| 62 | 10% | Pre-Heat | 05min | None | 90% |
| 66 | 10% | Pre-Heat | 05min | None | 90% |
| 37 | None | No-Pre-Heat | N/A | N/A | 85% |
| 8 | None | No-Pre-Heat | N/A | N/A | 85% |

FIGURE 7- JEWELRY CLEANING RESULTS (Sorted by Viscosity)

| TEST NBR | VISCOSITY | DISHWASH CYCLE | SOAK TIME | DELAY TIME | RESULT |
|---|---|---|---|---|---|
| 8 | None | No Pre-Heat | N/A | N/A | 85% |
| 37 | None | No Pre-heat | N/A | N/A | 85% |
| 70 | 10% | Pre-Heat | 10min | None | 95% |
| 68 | 10% | No Pre-Heat | 10min | None | 95% |
| 80 | 10% | No Pre-Heat | 15min | 60min | 95% |
| 78 | 10% | Pre-Heat | 15min | None | 95% |
| 76 | 10% | No Pre-Heat | 10min | None | 95% |
| 74 | 10% | No Pre-Heat | 10min | None | 95% |
| 72 | 10% | No Pre-Heat | 10min | 60min | 95% |
| 82 | 10% | No Pre-Heat | 15min | None | 95% |
| 62 | 10% | Pre-Heat | 05min | None | 90% |
| 60 | 10% | No Pre-Heat | 05min | None | 90% |
| 64 | 10% | No Pre-Heat | 05min | 60min | 92% |
| 66 | 10% | Pre-Heat | 05min | None | 90% |
| 49 | 25% | Pre-heat | 0min | 0min | 98% |
| 34 | 25% | No Pre-heat | 15min | 0min | 100% |
| 2 | 25% | Pre-heat | 20min | 0min | 100% |
| 28 | 25% | No Pre-heat | 20min | 0min | 100% |
| 25 | 25% | No-Pre-heat | 20min | 0min | 100% |
| 38 | 25% | Pre-heat | 20min | 0min | 100% |
| 12 | 25% | No-Pre-heat | 20min | 0min | 100% |
| 1 | 25% | No-Pre-heat | 30min | 0min | 100% |
| 54 | 25% | No-Pre-heat | 30min | 0min | 98% |
| 3 | 25% | No-Pre-heat | 30min | 0min | 98% |
| 44 | 25% | Pre-heat | 30min | 0min | 100% |
| 52 | 25% | Pre-heat | 30min | 0min | 100% |
| 24 | 25% | Pre-heat | 30min | 0min | 100% |
| 14 | 25% | No-Pre-heat | 30min | 0min | 100% |
| 31 | 25% | Pre-heat | 30min | 0min | 100% |
| 13 | 25% | Pre-heat | 30min | 0min | 100% |
| 43 | 25% | Pre-heat | 30min | 120min | 100% |
| 47 | 25% | Pre-heat | 30min | 60min | 100% |
| 41 | 25% | Pre-heat | 30min | 60min | 100% |
| 83 | 50% | No Pre-Heat | 15min | None | 98% |
| 77 | 50% | No Pre-Heat | 15min | None | 98% |
| 79 | 50% | Pre-Heat | 15min | None | 100% |
| 81 | 50% | No Pre-Heat | 15min | 60min | 99% |
| 65 | 50% | No Pre-Heat | 05min | 60min | 93% |
| 67 | 50% | Pre-Heat | 05min | None | 92% |
| 61 | 50% | No-Pre-Heat | 05min | None | 92% |
| 63 | 50% | Pre-Heat | 05min | None | 92% |

| TEST NBR | VISCOSITY | DISHWASH CYCLE | SOAK TIME | DELAY TIME | RESULT |
|---|---|---|---|---|---|
| 73 | 50% | No Pre-Heat | 10min | 60min | 98% |
| 75 | 50% | No Pre-Heat | 10min | None | 98% |
| 69 | 50% | No Pre-Heat | 10min | None | 98% |
| 71 | 50% | Pre-heat | 10min | None | 96% |
| 7 | 75% | No Pre-Heat | 0min | 0min | 98% |
| 17 | 75% | No-Pre-Heat | 10min | 0min | 98% |
| 22 | 75% | No Pre-Heat | 20min | 0min | 100% |
| 6 | 75% | No Pre-Heat | 20min | 0min | 100% |
| 23 | 75% | Pre-Heat | 20min | 0min | 100% |
| 30 | 75% | No-Pre-Heat | 20min | 0min | 100% |
| 29 | 75% | Pre-Heat | 20min | 0min | 100% |
| 57 | 75% | No-Pre-Heat | 20min | 0min | 100% |
| 58 | 75% | No-Pre-Heat | 30min | 0min | 100% |
| 32 | 75% | No-Pre-Heat | 30min | 0min | 100% |
| 56 | 75% | No-Pre-Heat | 30min | 0min | 100% |
| 21 | 75% | No-Pre-Heat | 30min | 0min | 100% |
| 26 | 75% | No-Pre-Heat | 30min | 0min | 100% |
| 18 | 75% | No-Pre-Heat | 30min | 0min | 100% |
| 35 | 75% | No-Pre-Heat | 30min | 0min | 100% |
| 45 | 75% | No-Pre-heat | 30min | 0min | 100% |
| 15 | 75% | No-Pre-heat | 30min | 0min | 100% |
| 11 | 75% | Pre-Heat | 30min | 0min | 100% |
| 55 | 75% | No-Pre-Heat | 30min | 0min | 100% |
| 39 | 75% | No-Pre-Heat | 30min | 0min | 100% |
| 48 | 75% | Pre-Heat | 30min | 0min | 100% |
| 51 | 75% | No-Pre-Heat | 30min | 0min | 100% |
| 5 | 75% | No-Pre-Heat | 30min | 0min | 100% |
| 27 | 75% | No-Pre-Heat | 30min | 60min | 100% |
| 53 | 75% | No-Pre-Heat | 30min | 60min | 100% |
| 19 | 75% | No-Pre-Heat | 60min | 0min | 100% |
| 20 | 75% | No-Pre-Heat | 60min | 60min | 100% |
| 40 | 90% | No-Pre-Heat | 30min | 0min | 98% |
| 4 | 100% | No-Pre-Heat | 25min | 0min | 100% |
| 36 | 100% | No-Pre-Heat | 30min | 0min | 98% |
| 9 | 100% | Pre-Heat | 30min | 0min | 100% |
| 10 | 100% | No-Pre-Heat | 30min | 0min | 98% |
| 16 | 100% | No-Pre-Heat | 30min | 0min | 98% |
| 42 | 100% | Pre-Heat | 30min | 0min | 98% |
| 46 | 100% | No-Pre-Heat | 30min | 0min | 98% |
| 33 | 100% | Pre-Heat | 30min | 60min | 95% |
| 50 | 100% | Pre-Heat | 30min | 60min | 95% |

METHOD AND KIT FOR CLEANING JEWELRY AND OTHER SMALL PARTS

FIELD OF INVENTION

The invention relates generally to the field of cleaning, and more particularly to a method and kit for cleaning of jewelry and other small parts.

BACKGROUND OF THE INVENTION

Precious stone and metal jewelry is at its most beautiful when perfectly clean and free from body oils, film, grime, and other deposits that can hide the shine, sparkle and character of the jewelry. Notwithstanding the desirability of maintaining jewelry in a very clean state, it is difficult to effectively clean jewelry.

The professional process of cleaning jewelry involves the following steps. First, the jewelry pieces are boiled in a concentrated cleaning solution for about 15 to 30 minutes. Next, the jewelry is removed from the concentrated cleaning solution and is rinsed with hot water. Lastly, the jewelry is subjected to high pressure steaming to quickly remove any remaining water to prevent spotting. While cleaning in this manner renders a piece of jewelry the benchmark 100% clean, the equipment, time, and steps involved in professionally cleaning jewelry is out of reach of the vast majority of consumers and even small jewelry stores with limited space. As a result, there have been attempts to devise less costly and involved devices and methods for cleaning jewelry. For example, liquid jewelry soaking solutions are available. A user will soak a jewelry piece for some time, and then attempt to brush away the grime. Results of about 30–50% are about the best achievable. Commercial ultrasonic jewelry cleaning machines are now being sold. However, these machines can only accomplish cleaning to about 70–80% clean.

U.S. Pat. No. 4,941,490 to Gross discloses a low temperature apparatus for cleaning jewelry. The Gross device delivers a low temperature mist of cleaning liquid and a stream of compressed warm air for drying the jewelry once it is cleaned.

U.S. Pat. No. 5,209,784 to Bellman discloses a method and apparatus for jewelry and small parts cleaning. In the Bellman method and apparatus, a large mesh basket with internal hooks posts and compartments is provided for placement in an automatic dishwasher, where the water and water laced detergent will be allowed to impinge on the jewelry pieces contained in the basket and thereby cause cleaning. According to Bellman, results of 80–85% cleaning can be achieved. While this range of results is comparable or better than that achieved with other available non-professional cleaning methods, it still falls short of the perfect results achieved by professional methods of cleaning, which leaves jewelry most brilliant.

Accordingly, there remains a need for a simple and easy to use method and kit for cleaning jewelry which achieves 95%+ cleaning results.

SUMMARY OF THE INVENTION

A method and jewelry holding basket for use in cleaning jewelry and small parts to a degree of 95% and greater.

In one embodiment of the invention there is disclosed a method of cleaning jewelry and small parts comprising:

a) providing a holding means with a plurality of apertures formed therein, wherein the holding means is adapted to securely retain jewelry and small parts therein;

b) placing jewelry and/or small parts in the holding means;

c) providing a container with cleaning solution contained therein;

d) placing the holding means with the contained jewelry and/or small parts in the container of cleaning solution to coat the jewelry and/or small parts with cleaning solution;

e) removing the holding means with the contained jewelry and/or small parts from the container of cleaning solution; and f) placing the holding means and contained jewelry and/or small parts in an automatic dishwasher and running the automatic dishwasher through a wash cycle and dry cycle, thereby exposing the jewelry and small parts to impinging water and the action of steam to remove the cleaning solution and grime from the jewelry and small parts.

In another aspect of the invention, there is disclosed a kit for cleaning jewelry and small parts comprising;

a holding means comprising a closeable container having a plurality of apertures formed therein, the holding means being adapted to securely retain jewelry and small parts therein; and a container with cleaning solution contained therein, and having a mouth opening sized to receive the holding means.

BRIEF DESCRIPTION OF THE DRAWINGS

FIG. 5 lists the Viscosity of the various concentrations of cleaning solution.

FIG. 6 lists the Jewelry Cleaning Results, Sorted by Results.

FIG. 7 lists the Jewelry Cleaning Results, Sorted by Viscosity.

DETAILED DESCRIPTION OF THE PREFERRED EMBODIMENTS

Figure 1:
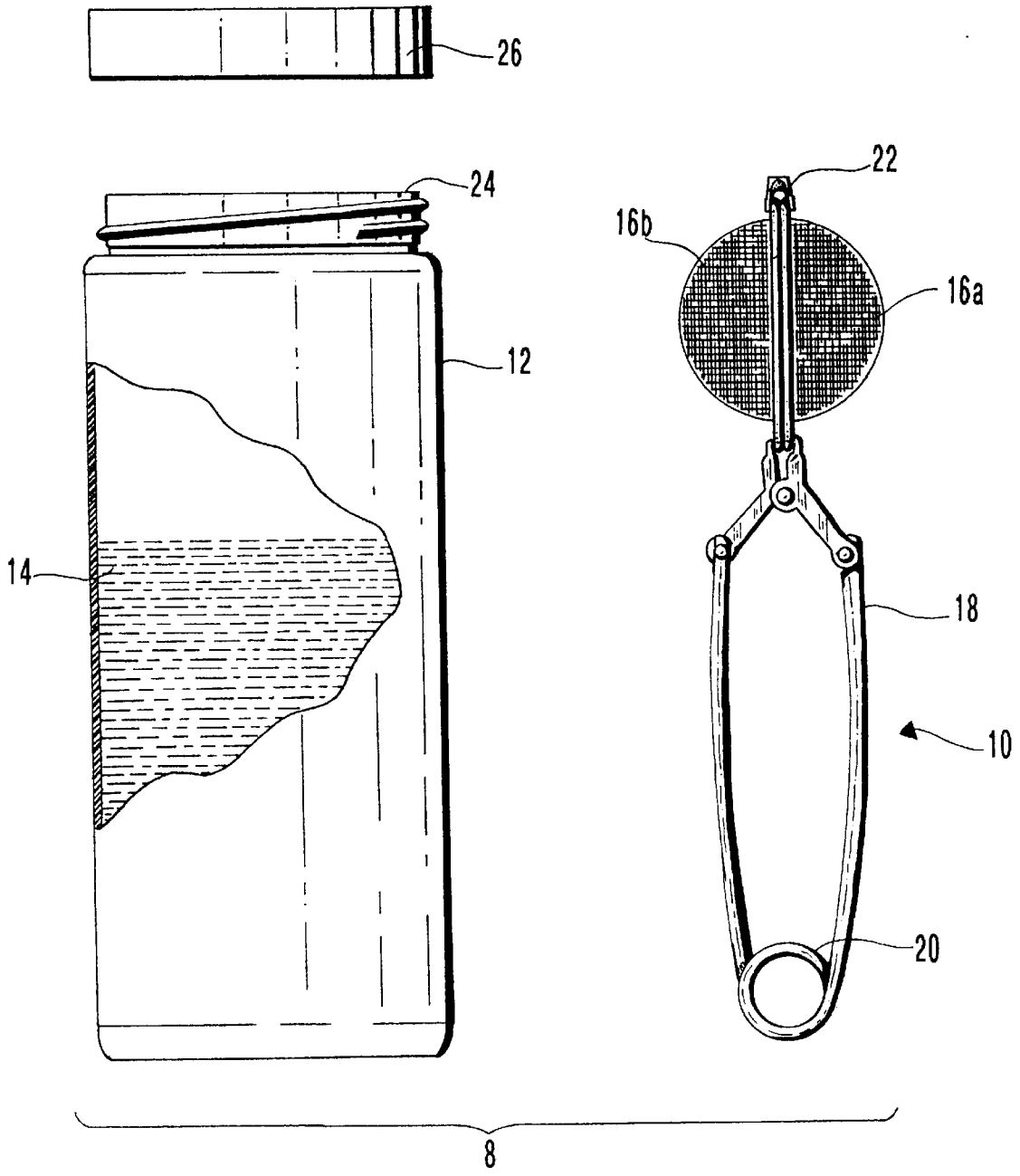
FIG. 1 is a perspective view of one embodiment of a jewelry holding basket and cleaning solution container of the invention.
Figure 2:
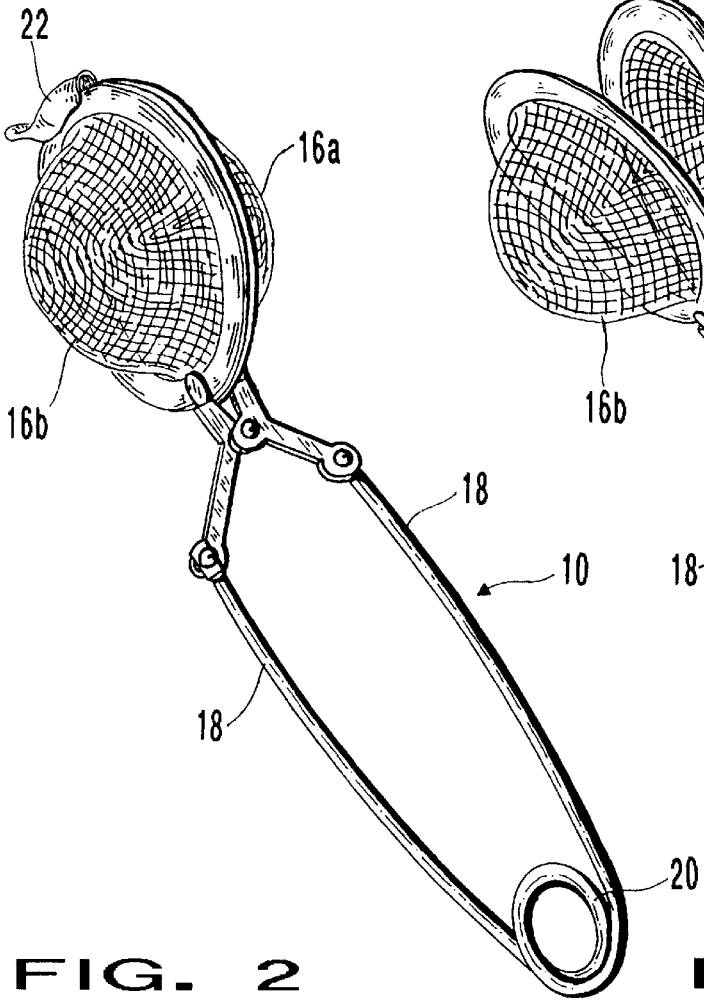
FIG. 2 is a perspective view of the jewelry holding basket in its opened position.
Figure 3:
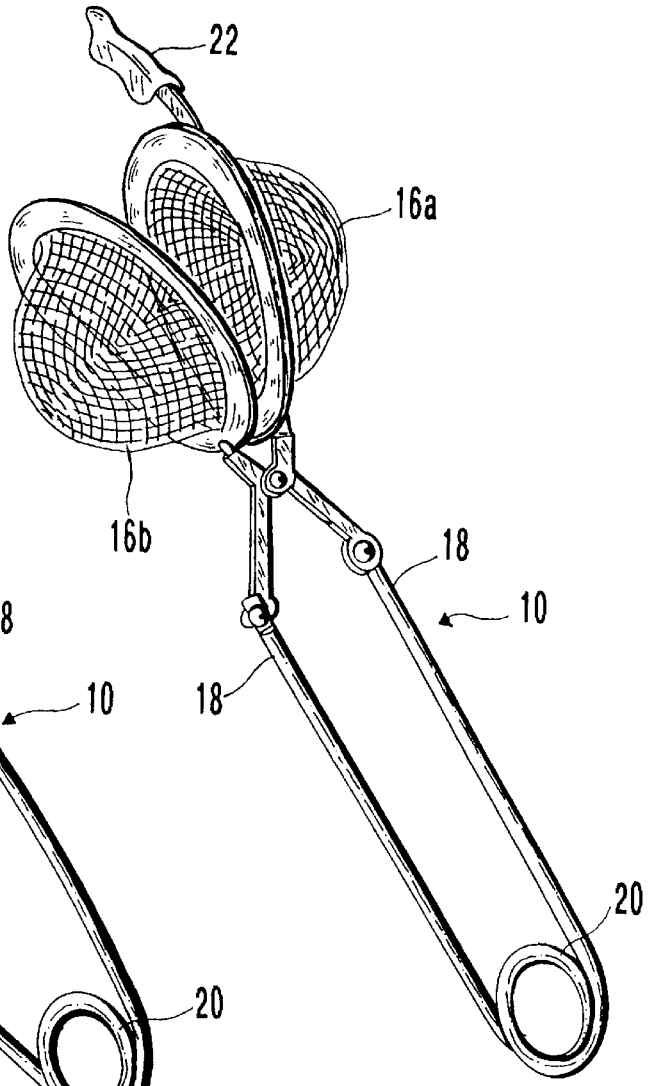
FIG. 3 is a perspective view of the jewelry holding basket in its closed position.

Referring first to FIG. 1, there is shown a perspective view of one embodiment of the jewelry and small parts cleaning kit 8 of the invention. Kit 8 comprises jewelry holding means 10 and cleaning solution container 12 with cleaning solution 14 contained therein. Cleaning solution container 12 is adapted to receive jewelry holding means 10. While reference is made to jewelry, small parts may also be contained in and cleaned by the method and kit 8.

Jewelry holding means 10 can conveniently comprise a generally spherical basket means of material with a large number of apertures to permit cleaning solution 14 to enter, but to prevent an item of jewelry or any parts thereof (not shown), such as loose stones, from inadvertently falling out of holding means 10. For example, the inventor has used jewelry holding basket 10 made of stainless steel mesh. The inventor has found that a stainless steel wire mesh, with a wire diameter of 0.125 mm, with 1600 openings per square inch, with each opening being about 0.509 mm in height and width, functions well. Made with material of these dimensions, stones as small as 0.01 carats will be prevented from passing through the mesh if the stone inadvertently becomes dislodged from the jewelry piece. Other mesh materials can also be used. Another advantage of using fairly fine mesh material is that relatively viscous cleaning solution will be readily be able to enter the basket and impinge upon nooks and crannies of intricate and detailed jewelry pieces, with some remaining on the jewelry piece in the basket after removal from the cleaning solution, so that the cleaning solution can continue to work until rinsed off. The disadvantages of using a mesh material that is too coarse can includes the inability to capture any stones that might fall off from the jewelry pieces, and also perhaps too fast a run out time of the cleaning solution. If the mesh is too fine, the cleaning solution and water and stream from the automatic dishwasher will not readily enter the basket and impinge on the jewelry pieces contained therein.

Jewelry holding means 10 can comprise two generally hemispherical hinged portions 16*a* and 16*b*. Handle portions 18 are attached to two joined portions 16*a* and 16*b*. A means to secure the two joined portions 16*a* and 16*b* in a closed position, such as a spring closure 20 and/or clasp 22, is preferably provided to prevent the basket 10 from possibly inadvertently opening and spilling the jewelry and/or small parts.

Container 12 preferably has a wide mouth opening 24 sized to receive jewelry holding means 10 so that holding means 10 and its contents can be fully immersed in the cleaning solution 14. A closure means 26 is preferably provided to close mouth opening 24 when the kit is not in use. Preferably, jewelry holding means 10 is sized to completely fit within the container 12. One advantage in providing holding means 10 that is generally hemispherical and that has handle portions 18 is that holding means can be easily fit into a circular mouth 24 of a container 12 with a screw on cap closure means 26, and without the user needing to touch cleaning solution 14.

The inventor has tested a wide variety of cleaning solutions. A key ingredient in all prior art jewelry solutions is ammonium. Ammonium is incompatible with automatic dishwashers due to the fumes. Surprising, the inventor has found that commonly available liquid dishwashing detergent (diluted to certain ranges, as will be discussed below) functions quite well. These liquid dishwashing detergents can contain water, chlorine bleach, potassium and sodium phosphates, potassium silicates, stabilizing agents, and a rinsing agent. For example, "Cascade" brand liquid dishwashing detergent, manufactured by Procter & Gamble, of Cincinnati, Ohio, has these ingredients, and has sufficient cleaning agents and viscosity (when diluted as discussed below) to penetrate, cling to, and thoroughly clean the jewelry. Other detergents having sufficient cleaning properties and proper viscosity (and preferably also a rinsing agent) can also be used. The viscosity of the cleaning solution was measured with a Baroid Marsh Funnel, and was measured in Marsh Seconds. FIG. 5 lists the specific gravity and viscosity of various dilutions of Cascade brand liquid dishwashing detergent.

In order to carry out accurate, reliable and repeatable tests, the following test protocol was employed. Two nearly identical benchmark rings were used interchangeably throughout the tests. Both were 14 kt yellow gold. One consisting of a 1.50 ct oval synthetic sapphire, surrounded by twelve 3.5 mm cubic zirconias, the other consisting of a 1.50 ct pear-shaped genuine emerald, surrounded by twelve 3.75 mm diamonds. Before each test was conducted, the two test rings were uniformly soiled using the following procedure.

1. The rings were dipped into a solution of bar hand soap, soft hand soap, hand cream, and concentrated liquid hand dishwashing detergent.
2. The rings were then rinsed with warm water, and allowed to air dry. At this point there was a noticeable film remaining on the rings.
3. The rings were then placed into an oven and warmed to 120 degrees F. for a period of 30 minutes. After cooling to room temperature, the rings were ready for testing.

Actual testing consisted of placing the test rings in jewelry holding basket 10, and placing jewelry holding basket 10 with the contained test rings into cleaning solution 14 in cleaning solution container 12. Jewelry holding basket 10 with the contained test rings was allowed to remain for varying soak times in cleaning solution 14. After the soak time (if any), jewelry holding basket 10 with the contained test rings was removed from cleaning solution 14 and placed in various automatic dishwashing machines. The dishwashing machines were then run through the full wash and dry cycle, with or without the pre-heat option.

Test results were determined as follows:

100%=equivalent to professional jeweler's soaking and steam cleaning process.

98%=very minimal amount of residual film remaining in detailed recessed areas of the test rings, only visible under 10 power magnification.

95%=minimal amount of residual film remaining in detailed recessed areas of the test rings, only visible under 10 power magnification.

93~90%=some areas of residual film remaining in detailed recessed areas of the test rings, visible without power magnification.

85%=residual film remaining in detailed recessed areas of the test rings, and on the stones, visible without power magnification.

Test results are summarized by results and concentration of cleaning solution, dishwasher cycle preheat or not, soak time, and delay time before turning on the dishwasher.

As can be seen from a review of the data of FIGS. 6 and 7, results of 90% cleaning and better were consistently achieved, so long as test rings were soaked in a cleaning solution having at least a 10% concentration and sufficient viscosity. In contrast, without cleaning solution, results of 80–85% (similar to that of Bellman Patent) resulted. By extending the soak time in a 10% concentration cleaning solution from 5 to 10 or 15 minutes, the cleaning results jumped from 90% to 95%. At about a 25% concentration cleaning solution, results of 98% or better are consistently achieved, with results of 100% being achieved with soak times of over 15 minutes and longer. When cleaning solution has an adequate viscosity some cleaning solution remains on the test rings even after removing from the container of cleaning solution, and continues to dissolve the grime. At about a 50% concentration of cleaning solution, the soak time can be shortened to about 5 minutes, yet still achieving acceptable results of at least 92%. By increasing soak times with the 50% concentration of cleaning solution to 10 minutes, cleaning jumps to 96~98%, with 15 minutes of soaking, 98% cleaning, and at 15+ minutes, 98~100%. The best results were generally achieved by 15 minute plus soak times in a 25% and higher concentration of cleaning solution. Using the pre-heat setting on the automatic dishwasher improved results slightly in the tests when the hot tap water temperature was below 120° F., probably due to quicker evaporation times of the water on the test rings. The delay time in waiting before starting the automatic dishwasher did not appear to be very important, except that in certain cases too long of a delay time would diminish the cleaning results.

The relationship between the viscosity of the cleaning solution and the cleaning effectiveness is evident as noted above, and as shown in FIG. 7, Jewelry Cleaning Results, Sorted by Viscosity. While too low of a concentration (i.e., 10% or less) and viscosity, is not preferably, because the cleaning solution runs too quickly off of the jewelry, going to too high of a viscosity, i.e. 100% cleaning solution, with a viscosity of about 1620 Marsh Seconds is not good either. At too high a viscosity, the cleaning solution has difficulty in entering the mesh of jewelry holding basket 12, and likewise will not fully penetrate the various details of the jewelry pieces.

A Run-Out Time Analysis of the cleaning solution to run out of the jewelry holding basket, full of cleaning solution, gives the following results:

| Concentration of Cleaning Solution | Time to Run Out | Solution Remaining |
|---|---|---|
| 10% | 1.0 seconds | 1.5% |
| 25% | 2.5 seconds | 2.5% |
| 50% | 5.0 seconds | 5.0% |
| 75% | 15.0 seconds | 8.3% |

The test results, sorted by results, is shown in FIG. 7. As can clearly be seen, results of 100%, equivalent to professional cleaning can now be consistently achieved with the method and kit of the invention.

Figure 4:
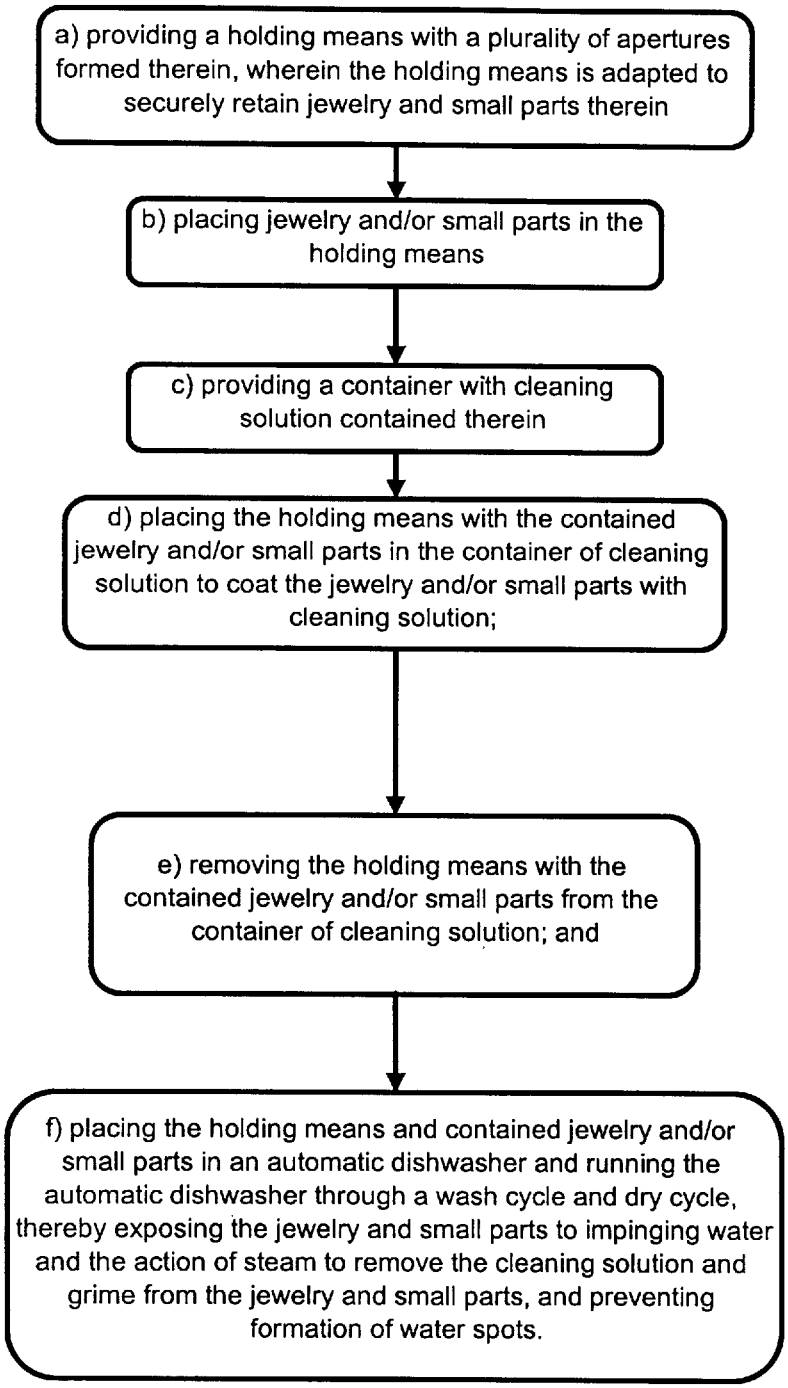
FIG. 4 is a flowchart showing the method of the invention.

The method of cleaning jewelry and small parts of the invention as shown in FIG. 4, thus comprises the following steps:

a) providing a holding means with a plurality of apertures formed therein, wherein the holding means is adapted to securely retain jewelry and small parts therein;

b) placing jewelry and/or small parts in the holding means;

c) providing a container with cleaning solution contained therein;

d) placing the holding means with the contained jewelry and/or small parts in the container of cleaning solution to coat the jewelry and/or small parts with cleaning solution;

e) removing the holding means with the contained jewelry and/or small parts from the container of cleaning solution; and f) placing the holding means and contained jewelry and/or small parts in an automatic dishwasher and running the automatic dishwasher through a wash cycle and dry cycle, thereby exposing the jewelry and small parts to impinging water and the action of steam to remove the cleaning solution and grime from the jewelry and small parts.

The method of the invention is enhanced and 98% and better cleaning results when the jewelry and/or small parts are soaked in a cleaning solution having a viscosity sufficiently low such that the cleaning solution will be able to thoroughly penetrate a jewelry piece or small part and yet have sufficiently good cleaning qualities. On the other hand, it is also desirable that a residual amount of the cleaning solution remains on the jewelry or small part in the jewelry containing means after being removed from the cleaning solution container so that soak times can be decreased. By balancing these two competing concerns, the benefits of shorter soak times, and effective cleaning can be achieved.

The drawings and the foregoing description are not intended to represent the only form of the invention in regard to the details of its methodology and manner of operation. In fact, it will be evident to one skilled in the art that modifications and variations may be made without departing from the spirit and scope of the invention. Although specific terms have been employed, they are intended in a generic and descriptive sense only and not for the purpose of limitation.

I claim:

1. A method of cleaning jewelry and small parts comprising:

a) providing a closeable holding means with a plurality of apertures formed therein, wherein the holding means is adapted to securely retain jewelry and small parts therein;

b) placing jewelry and/or small parts in the closeable holding means;

c) providing a container with non-ammonia-based cleaning solution contained therein;

d) placing the closeable holding means containing the jewelry and/or small parts in the container of non-ammonia-based cleaning solution to coat the jewelry and/or small parts with non-ammonia-based cleaning solution;

e) removing the closeable holding means with the contained jewelry and/or small parts from the container of non-ammonia-based cleaning solution; and f) placing the closeable holding means and contained jewelry and/or small parts in an automatic dishwasher and running the automatic dishwasher through a wash cycle and dry cycle, thereby exposing the jewelry and small parts to impinging water and steam generated by the automatic dishwasher to remove the non-ammonia-based cleaning solution and grime from the jewelry and/or small parts.

2. The method of claim 1, wherein the non-ammonia-based cleaning solution comprises detergents and a rinsing agent.

3. The method of claim 1, wherein the non-ammonia-based cleaning solution comprises detergents having a viscosity that is higher than water so that some portion of the cleaning solution remain on the jewelry and/or small parts even after being removed from the container of cleaning solution.

4. The method of claim 1, wherein the holding means comprises two approximately hemispherical hinged basket portions adapted for secure containment of jewelry and/or small parts inside the two hinged basket portions when in a closed position, the hinged basket portions having means to securely lock jewelry and/or small parts therein, and wherein the provided container has a mouth opening sized to receive the holding means.

5. The method of claim 1, wherein the holding means with the contained jewelry and/or small parts is allowed to soak in the container of non-ammonia-based cleaning solution for at least 10 minutes.

6. The method of claim 1, wherein the non-ammonia-based cleaning solution comprises liquid dishwashing detergent diluted with water.

7. The method of claim 1, wherein the non-ammonia-based cleaning solution comprises at least 25% liquid dishwashing detergent and 75% or less water, and wherein the jewelry and/or small parts are allowed to soak in the cleaning solution for at least 10 minutes.

8. A method of cleaning jewelry and small parts comprising:

a) providing a closeable holding means with a plurality of apertures formed therein, wherein the holding means is adapted to securely retain jewelry and small parts therein;

b) placing jewelry and/or small parts in the holding means;

c) providing a container with diluted non-ammoniated liquid dishwasher detergent contained therein;

d) placing the holding means containing the jewelry and/or small parts in the container of diluted non-ammoniated liquid dishwasher detergent to coat the jewelry and/or small parts with diluted non-ammoniated liquid dishwasher detergent and permitting the jewelry and/or small parts to soak in the diluted non-ammoniated liquid dishwasher detergent;

e) removing the holding means with the contained jewelry and/or small parts from the container of diluted non-ammoniated liquid dishwasher detergent; and f) placing the holding means and contained jewelry and/or small parts in an automatic dishwasher and running the automatic dishwasher through a wash cycle and dry cycle, thereby exposing the jewelry and/or small parts to impinging water and steam generated by the automatic dishwasher to remove the diluted non-ammoniated liquid dishwasher detergent and grime from the jewelry and/or small parts.

* * * * *